US012800273B2

(12) United States Patent
Cheng

(10) Patent No.: US 12,800,273 B2
(45) Date of Patent: Nov. 17, 2026

(54) DUAL-PURPOSE MULTI-AXIS TARGET SHOOTING MACHINE STEERING DEVICE

(71) Applicant: IDP CO., LTD., New Taipei City (TW)

(72) Inventor: Chen-Tse Cheng, New Taipei City (TW)

(73) Assignee: IDP CO., LTD., New Taipei City (TW)

( * ) Notice: Subject to any disclaimer, the term of this patent is extended or adjusted under 35 U.S.C. 154(b) by 201 days.

(21) Appl. No.: 18/988,964

(22) Filed: Dec. 20, 2024

(65) Prior Publication Data

US 2026/0177360 A1 Jun. 25, 2026

(51) Int. Cl.
*F41J 9/02* (2006.01)

(52) U.S. Cl.
CPC ..... *F41J 9/02* (2013.01)

(58) Field of Classification Search
CPC ..... F41J 9/02
See application file for complete search history.

(56) References Cited

U.S. PATENT DOCUMENTS 9,612,092 B2 * 4/2017 Chester ..... F41J 5/056

FOREIGN PATENT DOCUMENTS

FR 2830611 A1 * 4/2003 ..... F41J 9/02
KR 20040092546 A * 11/2004
TW M476914 4/2014

OTHER PUBLICATIONS

Machine translation of KR 20190139819 (Year: 2019).*
KR20190139819 image and machine translation (Year: 2019).*

* cited by examiner

*Primary Examiner* — Brian O Peters
(74) *Attorney, Agent, or Firm* — Fei-Hung Yang

(57) ABSTRACT

A dual-purpose multi-axis target shooting machine steering device includes an operation box, the first mode control unit, the second mode control unit and a target shooting mode switching unit. The first and second mode control units are located on two adjacent sides of the operation box respectively, the first mode control unit comprises the first power module, the first target stand and the first target board, and the second mode control unit comprises the second power module, the second target stand and the second target board. The first target board can fall sideway, fall sideway and then rotate, and rotate relative to the operation box, and the second target board can fall backward relative to the operation box. The target shooting mode switching unit can quickly switch between the first and second mode control units.

9 Claims, 9 Drawing Sheets

1

DUAL-PURPOSE MULTI-AXIS TARGET SHOOTING MACHINE STEERING DEVICE

BACKGROUND OF THE DISCLOSURE

Technical Field

The present disclosure relates to the field of shooting training equipment, and more particularly relates to a dual-purpose multi-axis target shooting machine steering device having a first mode control unit, a second mode control unit and a target shooting mode switching unit. The target shooting mode switching unit toggles between the first mode control unit and the second mode control unit to quickly switch to different target training modes in different spatial environments.

Description of the Related Art

In general, soldiers, policemen, or athletes use imaginary targets in their shooting training to improve the accuracy of the use of firearms. At present, rotary target machines are usually used in the training, and the rotary target machines can make a target board to rotate dynamically and simulate the actual shooting in a variety of situations that may be encountered, so as to improve the efficiency of the shooting training.

Existing rotary target machine is a driving assembly with a target board, through the power of the driving assembly to drive the target board to perform a single-axis rotary movement. In the shooting training on site arrangement, multiple sets of rotary target machines are usually set up for a variety of different timing and different shooting training effects to improve shooting skills. As disclosed in R.O.C. Utility Model No. M476914 entitled "Rotary target machine", the rotary target machine includes: a driving assembly with a power unit, a first rotary lever, a second rotary lever and a transmission lever, wherein an end of the first rotary lever is fixed to the power unit, the second rotary lever is pivoted to the other end of the first rotary lever, the transmission lever is pivoted to the other end of the second rotary lever, and the other end of the transmission lever is provided with a connector. There are at least two connecting rods sequentially pivoted to each other, one of the connecting rods is pivoted to the connector of the transmission lever, the other connecting rods are sequentially extended and pivoted to the previous connecting rod. There are at least two target bases, and the target bases are connected to the corresponding connecting rods respectively. Through the forward and reverse rotations of the driving assembly to drive the connecting rod, and the attachment of the link rod of the target base with the target board, the effect of dynamic rotations in different directions is achieved. By the connection of the plural connecting rods with the plural target seats, the set of driving assembles can simultaneously drive the plural target bases in order to reduce the cost of procurement and maintenance and the occupancy of space. However, a target machine that can only rotate or swing does have a significant problem in actual training. Since most of the shooting ranges are set up in sparsely populated places, the design of the bullet trap is also designed according to the conditions of the site, sometimes when there is enough space, these target machines come with a design of falling backward after impact, but when the space is limited, the target machines come with a design of falling sideways after impact. Currently there is a dual-mode target machine on the market, with the dual power source, it simultaneously provides two modes: falling backward and sideways. However, in practice, the target board has certain width, usually larger than the target machine, so in the sideway fall mode, there should be enough space left for the target board falling sideways otherwise, when the target board falls sideway, the target board will be damaged by hitting the ground. Thus, further improvements are required.

In view of this, the discloser of the invention designed a multi-axis target shooting device for training, which can quickly switch between different target boards, and the two target boards perform different axial movements relative to the operation box. The multi-axis target shooting device includes a first mode control unit, a second mode control unit and a switching unit. The switching unit has switching to drive different target training modes for different spatial environments through the first mode control unit and the second mode control unit, simulating a variety of different situations and shooting conditions of the shooting site, and allowing trainees to switch the training modes according to different spatial restrictions and make quick response to the situation at site, so as to improve the training effect.

SUMMARY OF THE DISCLOSURE

One of the objectives of the present disclosure is to provide a dual-purpose multi-axis target shooting machine steering device, which includes an operation box, a first mode control unit, a second mode control unit and a switching unit, the switching unit switch between the first mode control unit and the second mode control unit. Wherein the first target board can perform the movements of falling sideway, falling sideway and then rotating, and rotating relative to the operation box, and the second target board can perform the movement of falling backward relative to the operation box, so that it can quickly switch between different target training modes within spatial restrictions.

To achieve the aforementioned objective, the present disclosure discloses a dual-purpose multi-axis target shooting machine steering device, for soldiers, athletes for shooting training, which includes: an operation box, with a first hole and a second hole on adjacent sides of the operation box respectively. The first mode control unit is located near the first hole of the operation box and provided with the first power module, the first target stand and the first target board. The first target stand dynamically connected to the first power module and located outside the operation box, and the first target board being fastened at the first target stand, which drives the first target board to perform the movements of falling sideway, falling sideway and then rotating, and rotating relative to the operation box. The second mode control unit is located outside of the second hole of the operation box, and the second mode control unit connected to the second power module, the second target stand and the second target board. The second target board is fastened to the second target stand, which drives the second target board to perform the movement of falling backward relative to the operation box. And the target shooting mode switching unit, electrically connected to the first mode control unit and the second mode control unit, and switching power output between the first mode control unit and the second mode control unit to drive the first mode control unit or the second mode control unit.

One embodiment of the present disclosure, the first power module includes the first fastened frame, the first motor, the first transmission mechanism, the first target arm and the second motor, the first fasten frame is installed on a side of the operation box near the first hole. The first motor and the first transmission mechanism are installed on the first fastened frame, and the first motor is with the first drive shaft, the first transmission mechanism is with the first input shaft and the first output shaft. Thus, the first drive shaft is dynamically connected to the first input shaft, the first output shaft through the first hole and connected to the first target arm. The other end of the first output shaft is connected to the second motor, which has a second drive shaft dynamically connected to the first target stand. In addition, the first power module includes a first limiting mechanism including the first limiting mechanism with the first locating ring, a first stop part and the first snap-action switch. The first positioning ring is arranged at the first output shaft, and the first stop part and the first snap-action switch are located on the rotation path of the first positioning ring, and the first stop part and the first snap-action switch turned relatively 90 degrees to the first output shaft, and the first snap-action switch is electrically connected to the first motor. When the first positioning ring triggers the first snap-action switch, the power of the first motor went out immediately. For easy assembly, the end of the first target arm is with a first fasten ring for sheathing on the first output shaft, and the other end of the first target arm is with the first fasten part to install the first target stand.

Another embodiment of the present disclosure, the second power module includes a second fastened frame, a third motor, a second transmission mechanism and a second target arm. The second fixed fastened frame is mounted on a side of the operation box near the second hole, the third motor and the second transmission mechanism are mounted on the second fastened frame, the third motor is with a third drive shaft, and the second transmission mechanism is with a second input shaft and the second output shaft. Thus, the third drive shaft dynamically connected to the second input shaft, the second output shaft is connected to the second target arm through of the second hole. In addition, the second power module includes the second limiting mechanism with the second positioning ring, the second stop part and a second snap-action switch, the second positioning ring is mounted to the second output shaft, and the second stop part and the second snap-action switch are located on the rotation path of the second positioning ring, snap-action switch turned relatively 90 degrees to the second output shaft, the second snap-action switch is electrically connected to the third motor. When the second positioning ring triggers the second snap-action switch and the power of the third motor will be off immediately. For easy assembly, the end of the second target arm is with the second fasten ring for sheathing on the second output shaft, and the other end of the second target arm is with a second fasten part to install the second target stand.

The other embodiment of the present disclosure, the dual-purpose multi-axis target shooting machine steering device includes a power input module mounted on the other side of the operation box relative to the first hole., and the power input module is electrically connected to the target shooting mode switching unit. In addition, the first target stand and the second target stand are clamped to the first target board and the second target board, so as to significantly convenient to disassemble and reassemble while replacing with new parts.

BRIEF DESCRIPTION OF THE DRAWINGS

PIC. 1 is a schematic view showing the structure of a preferred embodiment of the present disclosure.

DETAILED DESCRIPTION OF THE PREFERRED EMBODIMENTS

Figure 1:
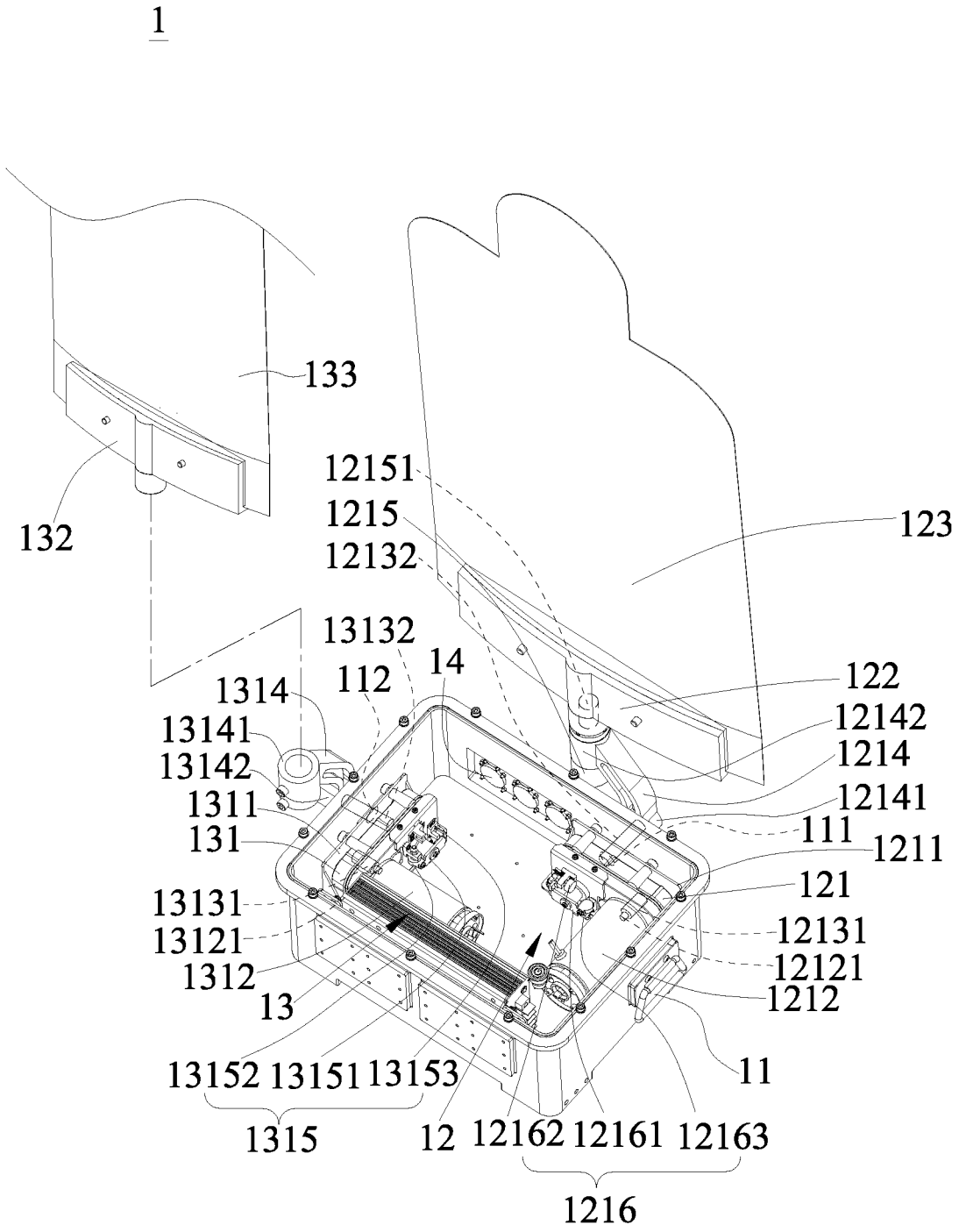
Figure 2:
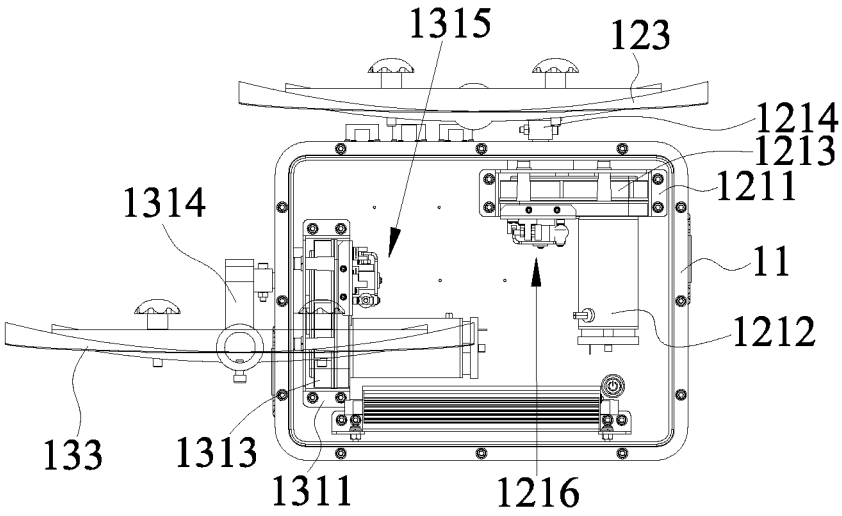
FIG. 2 is a schematic view showing the configuration of a preferred embodiment of the present disclosure.

To make it easier for Review Committee to understand the content of the present disclosure, the specification accompanied by the drawings is described as follows.

With reference to FIGS. 1 to 7 for the schematic views of the structure and configuration, the schematic views of various statuses of using the first mode control unit, the schematic views of various statuses of using the second mode control unit, and the schematic views of the configuration and structure of various mode control units in accordance with a preferred embodiment of the present disclosure respectively, the present disclosure discloses a dual-purpose multi-axis target shooting machine steering device 1 which includes an operation box 11, the first mode control unit 12, the second mode control unit 13 and a target shooting mode switching unit 14 for soldiers or athletes for shooting training.

Two adjacent sides of the operation box 11 are the first hole 111 and the second hole 112 respectively as shown in the figures, the first hole 111 is located on the rear side of the operation box 11, and the second hole 112 is located on the left side of the operation box 11.

The first mode control unit 12 is fixed inside the operation box and on one side near the first hole 111, the first mode control unit 12 is with the first power module 121, the first target stand 122 and the first target board 123, the first target stand 122 is dynamically connected to the first power module 121 and located outside the operation box 11, the first target board 123 is fastened on the first target stand 122, the first target stand 122 can drive the first target board 123 to perform the movements of falling sideway, falling sideway and then rotating, and rotating relative to the operation box 11. It is noteworthy that the first power module 121 includes a first fasten frame 1211, the first motor 1212, the first transmission mechanism 1213, the first target arm 1214 and the second motor 1215, the first fixed frame 1211 is mounted on a side of the operation box 11 near the first hole 111, the first motor 1212 and the first transmission mechanism 1213 are mounted on the first fixed frame 1211, the first motor 1212 is with the first drive shaft 12121, and the first transmission mechanism 1213 is with the first input shaft 12131 and the first output shaft 12132, such that the first drive shaft 12121 is dynamically connected to the first force input shaft 12131, the first force output shaft 12132 is through of the first hole 111 and connected to the first target arm 1214, the other end is connected to the second motor 1215, and the second motor 1215 is with a second drive shaft 12151 and dynamically connected to the first target stand 122. In addition, the first power module 12 includes the first limiting mechanism 1216 with the first positioning ring 12161, the first stop part 12162 and the first snap-action switch 12163, the first positioning ring 12161 is mounted to the first output shaft 12132, and the first stop part 12162 and the first snap-action switch 12163 are located on the rotation path of the first positioning ring 12161. The first stop part 12162 and the first snap-action switch 12163 is on the rotating path of the first positioning ring 12161. The first output shaft 12132, the first snap-action switch 12163 is electrically connected to the first motor 1212. After the first positioning ring 12161 triggers the first limit switch 12163, the operation of the first motor 1212 will be off immediately. In addition, the end of the first target arm 1214 is with the first retaining ring 12141 for sheathing on the first output shaft 12132, and the other end of the first target arm 1214 is with the first fasten part 12142 for installing the first target stand 122.

The second mode control unit 13 is mounted inside the operation box 11 on one side near the second hole 112, the second mode control unit 13 is with the second power module 131, the second target stand 132 and the second target board 133, the second target stand 132 is dynamically connected to the second power module 131 and located outside the operation box 11, the second target board 133 is fastened on the second target stand 132, and the second target stand 132 can drive the second target board 133 to perform a movement of falling backward relative to the operation box 11. It is noteworthy that the second power module 131 includes the second fasten frame 1311, the third motor 1312, the second transmission mechanism 1313 and the second target arm 1314, the second fasten frame 1311 is mounted in the operation box 11 on one side near the second hole 112, the third motor 1312 and the second transmission mechanism 1313 are installed on the second fasten frame 1311, the third motor 1312 is with the third drive shaft 13121, and the second transmission mechanism 1313 is with the second input shaft 13131 and the second output shaft 13132. Thus, the third drive shaft 13121 is dynamically connected to the second input shaft 13131, the second output shaft 13131 is through the second hole 112 and connected to the second target arm 1314. The second power module 131 includes the second limiting mechanism 1315 with the second positioning ring 13151, the second stop part 13152 and the second snap-action switch 13153, the second positioning ring 13151 is mounted to the second output shaft 13132, the second stop part 13152 and the second snap-action switch 13153 are located on the rotation path of the second positioning ring 13151, an angle between the second stop part 13152 and the second snap-action switch 13153 is 90 degrees with respect to the second output shaft 13132, and the second snap-action switch 13153 is electrically connected to the third motor 1312. After the second positioning ring 13151 triggers the second snap-action switch 13153, the operation of the third motor 1312 will be off immediately. The other end of the second target arm 1314 is with the second retaining ring 13141 for sheathing on the second output shaft 13132, and the other end of the second target arm 1314 is with the second fixed part 13142 for installing the second target stand 132.

The target shooting mode switching unit 14 is electrically connected to the first mode control unit 12 and the second mode control unit 13 and switching power output between the first mode control unit 12 to the second mode control unit 13 to drive the first mode control unit 12 or the second mode control unit 13. In addition, the dual-purpose multi-axis target shooting machine steering device 1 of the present disclosure includes a power input module 15 installed on another side of the fixed box 11 opposite to the first perforation 111, the power input module 15 is electrically connected to the target shooting mode switching unit 14, and the first target stand 122 and the second target stand 132 are mounted to the first target board 123 and the second target board 133 respectively by clamping.

Figure 3:
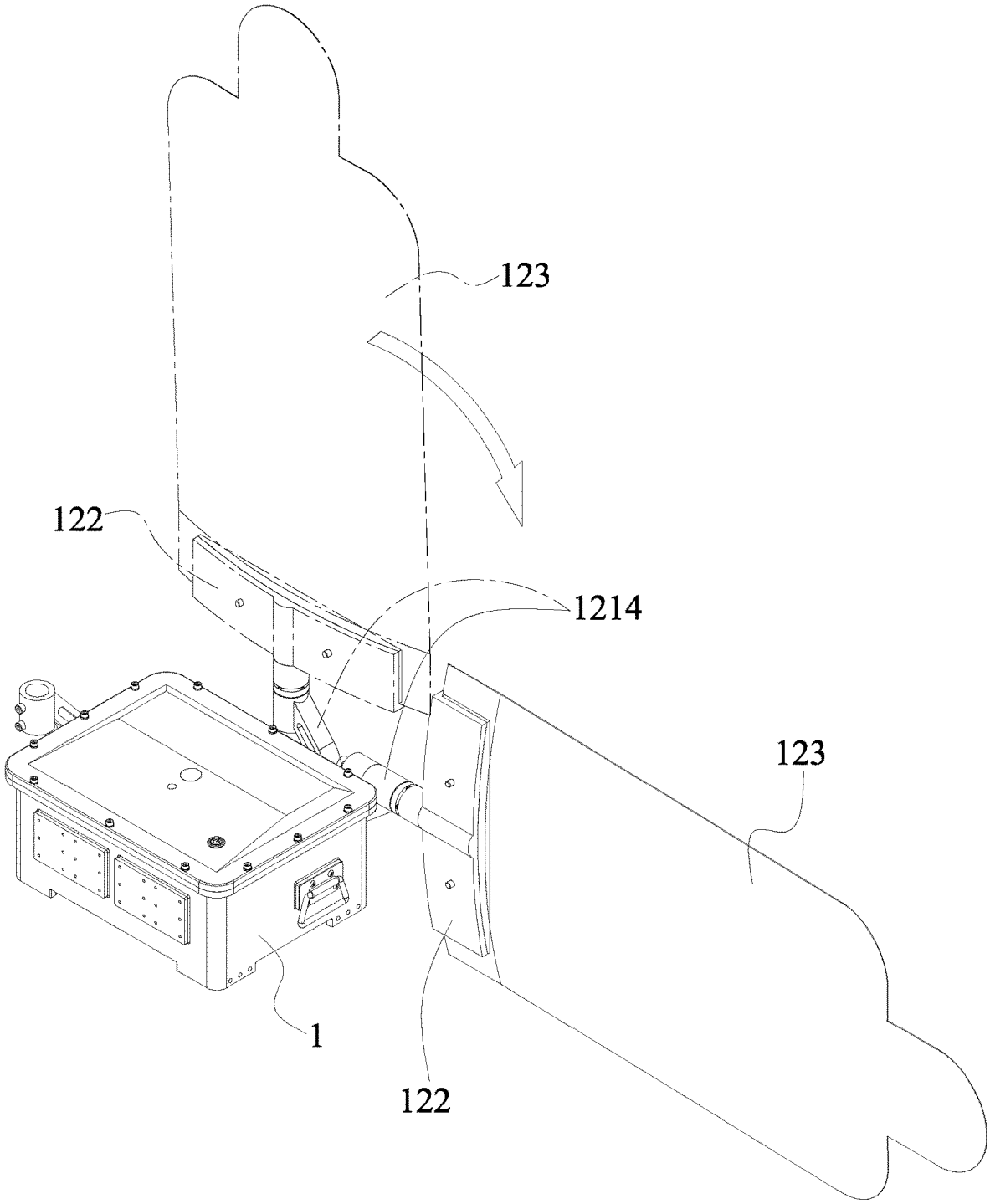
FIG. 3 is a first schematic view showing the status of using the first control unit in accordance with a preferred embodiment of the present disclosure.
Figure 4:
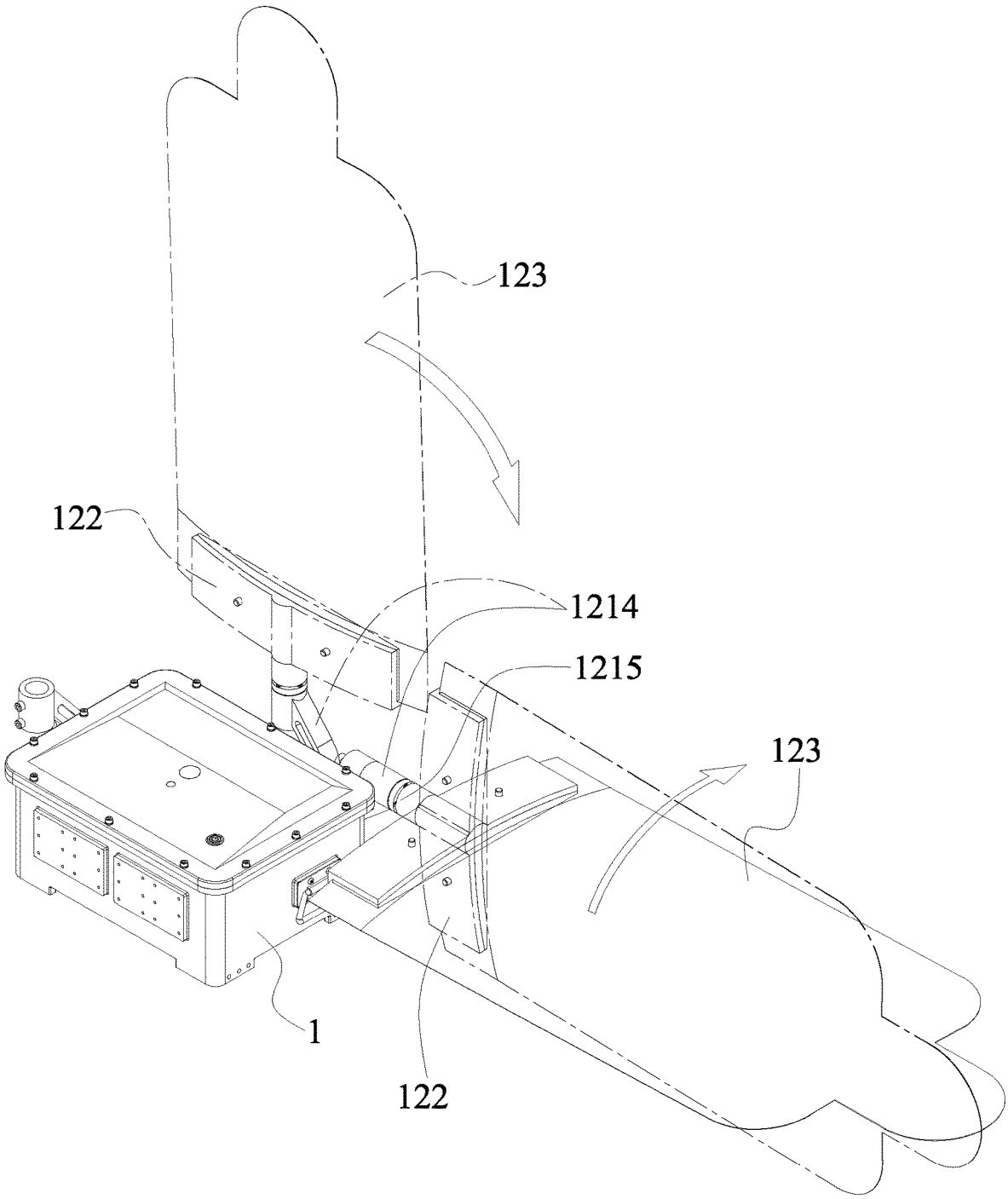
FIG. 4 is the second schematic view showing the status of using the first control unit in accordance with a preferred embodiment of the present disclosure.
Figure 5:
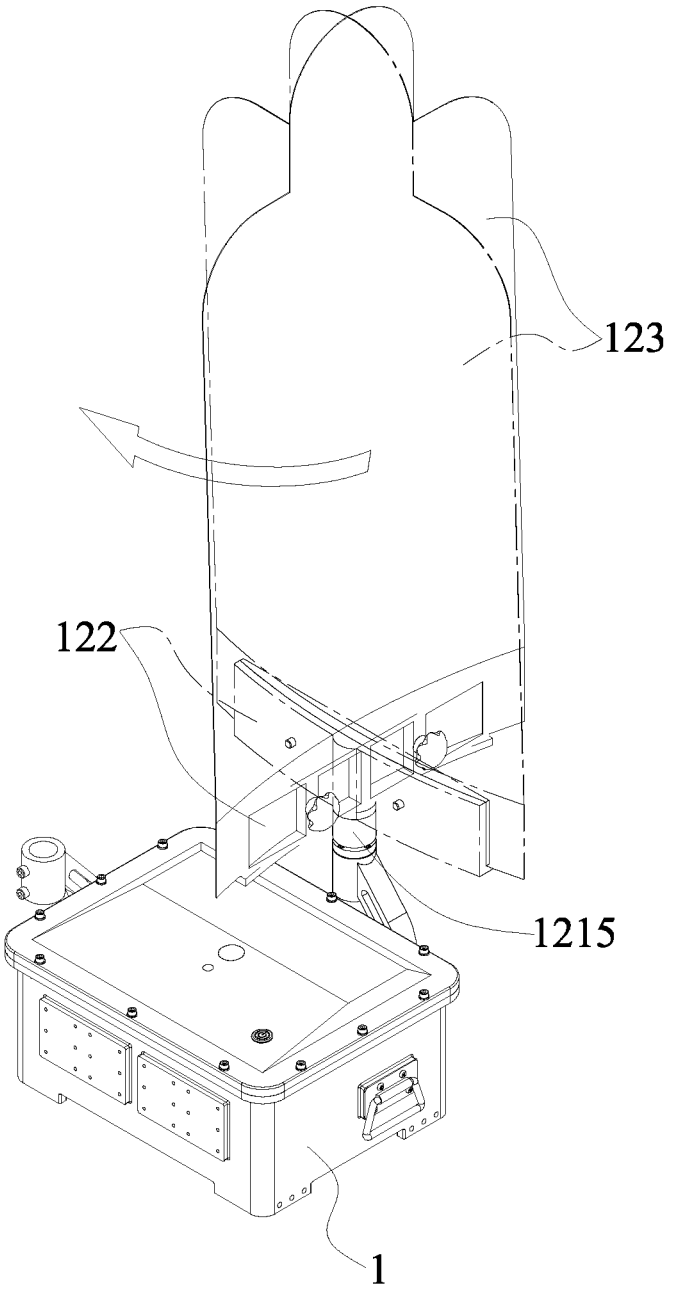
FIG. 5 is the third schematic view showing the status of using the first control unit in accordance with a preferred embodiment of the present disclosure.
Figure 6:
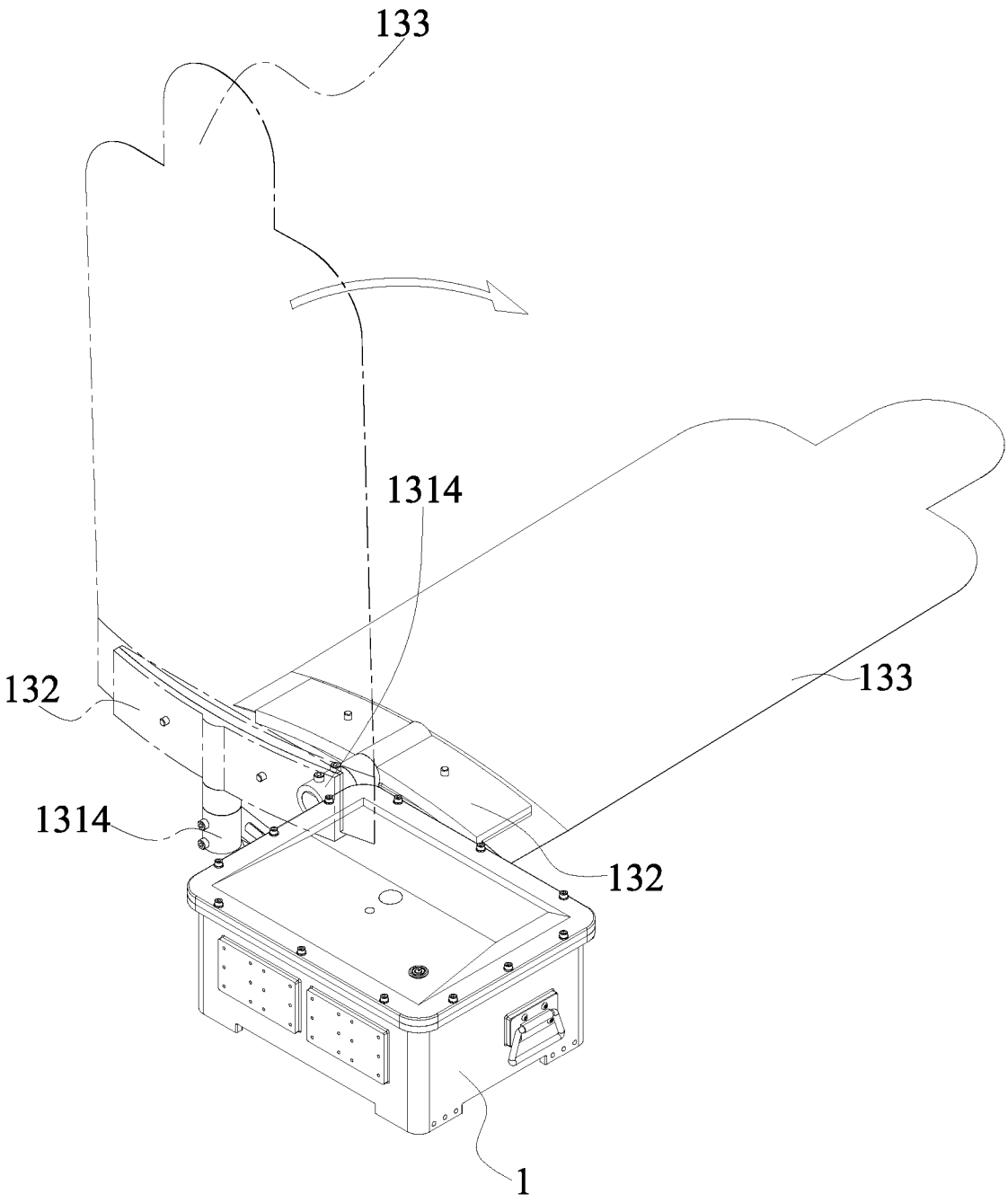
FIG. 6 is the first schematic view showing the status of using the second control unit in accordance with a preferred embodiment of the present disclosure.
Figure 7:
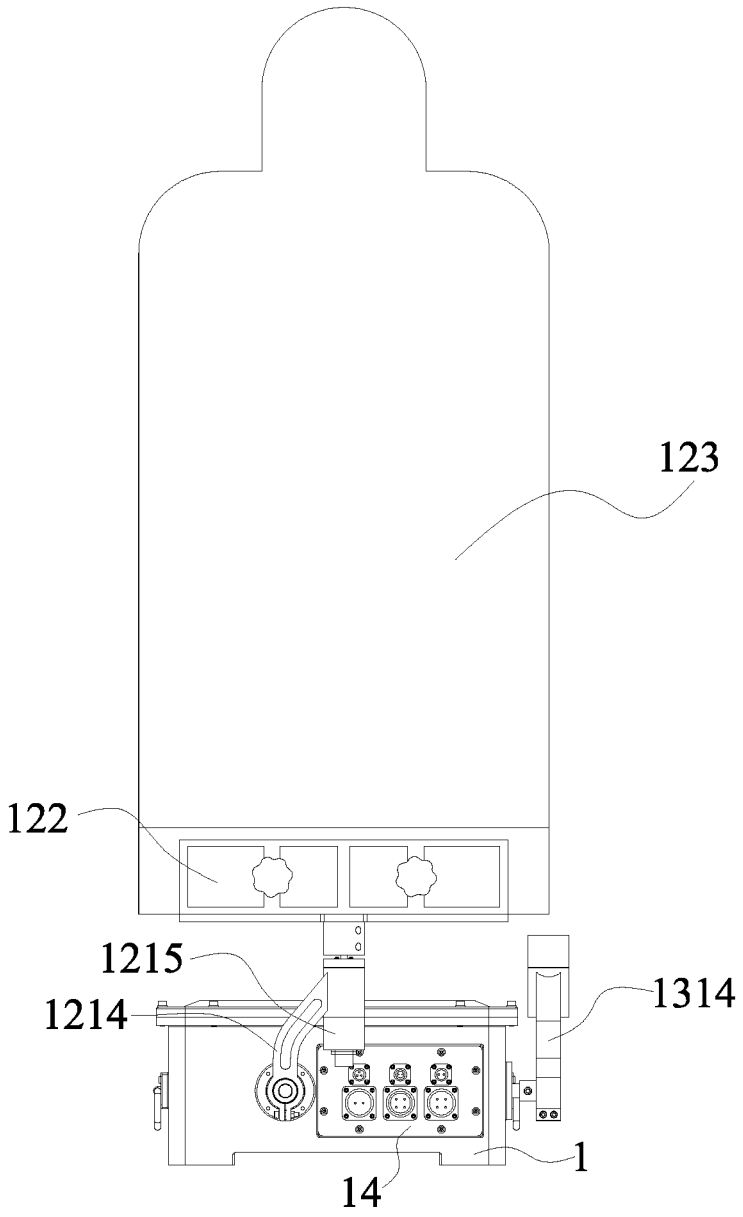
FIG. 7 is a schematic view showing the structure of a preferred embodiment of the present disclosure, viewing from different angle of view
Figure 8:
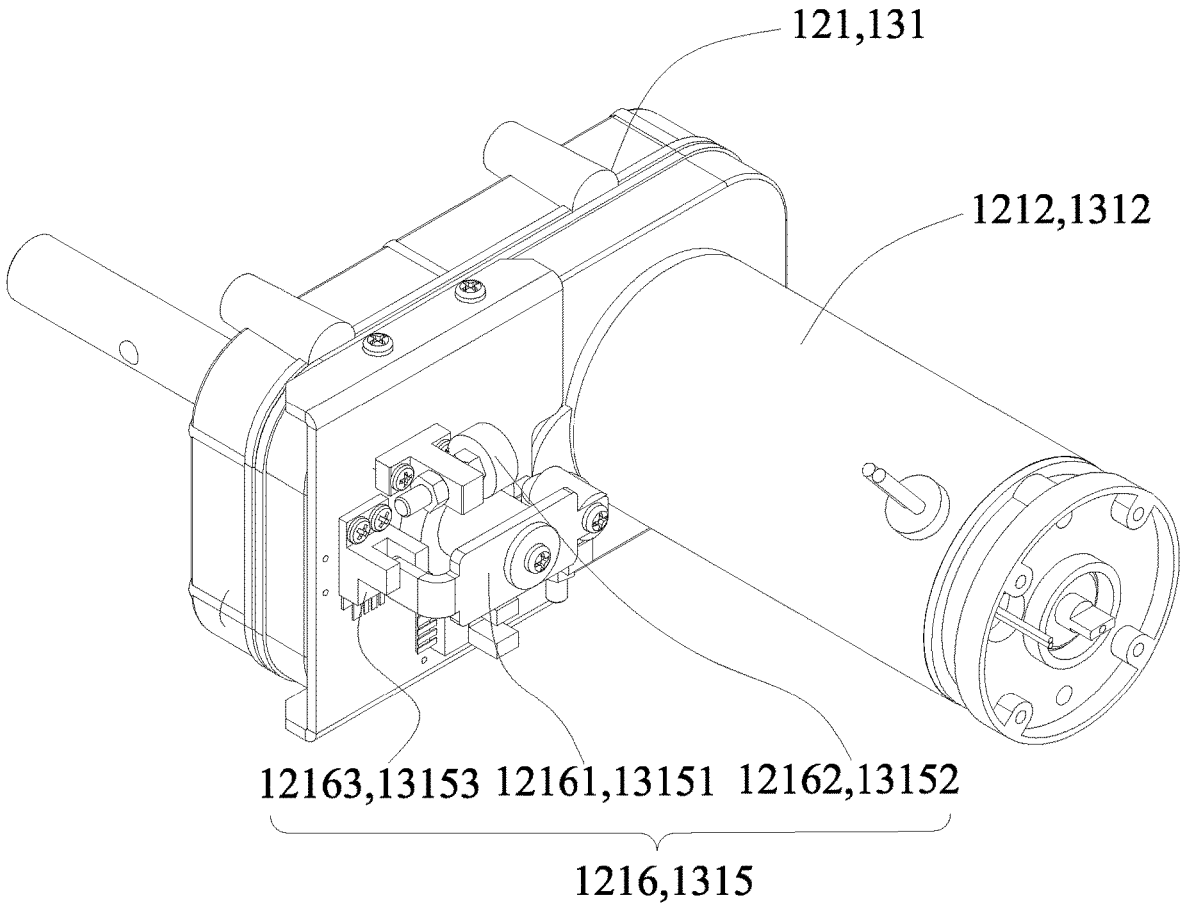
FIG. 8 is a schematic view showing the configuration of different mode control units in accordance with a preferred embodiment of the present disclosure.
Figure 9:
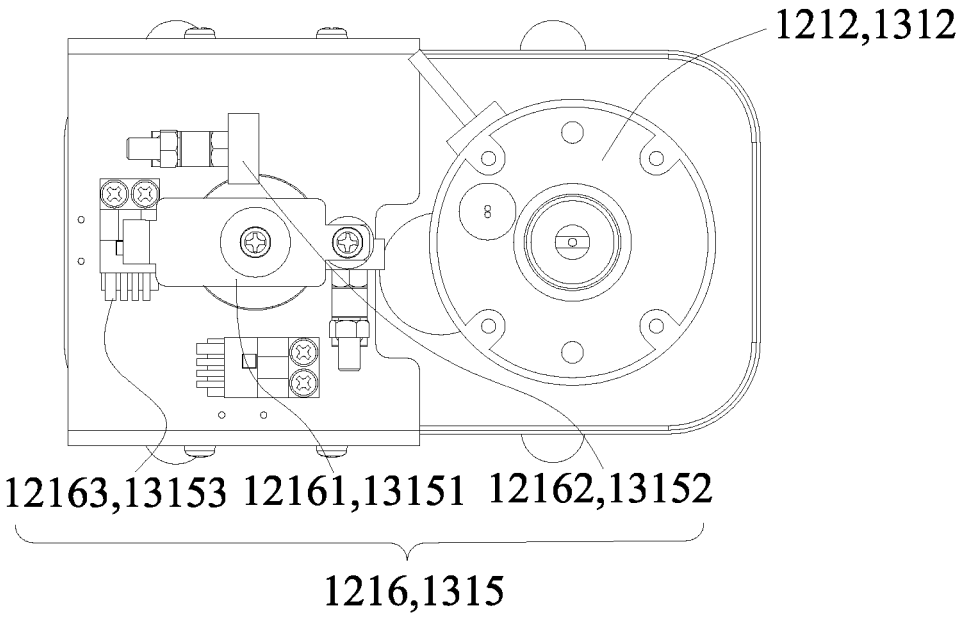
FIG. 9 is a schematic view showing the structure of different mode control units in accordance with a preferred embodiment of the present disclosure.

In this way, as shown in FIGS. 3 to 5, when the dual-purpose multi-axis target shooting machine steering device 1 of the present disclosure uses the first mode control unit 12, the first target board 123 can be driven to perform the movements of falling sideway, falling sideway and then rotating, and rotating relative to the operation box. As shown in FIG. 7, when the dual-purpose multi-axis target shooting machine steering device 1 of the present disclosure uses the second mode control unit 13, the second target stand 132 can drive the second target board 133 to perform a movement of falling backward relative to the operation box 11. Whether on the first mode control unit 12 or the second mode control unit 13, the first target board 123 or the second target board 133 are calculated carefully curated, they will not hit the operation box 11 and its surroundings after falling, so as to avoid damage from falling and impact. And, to switch between different target training modes within spatial environment limits.

What is claimed is:

1. A dual-purpose multi-axis target shooting machine steering device, for soldiers or athletes for shooting training, comprising: an operation box, with a first hole and a second hole located on two adjacent sides of the operation box respectively; a first mode control unit, fastened in the operation box and on one side of the operation box proximate the first hole, the first mode control unit comprising a first power module, a first target stand, and a first target board, the first target stand being dynamically coupled to the first power module and located outside the operation box, and the first target board fastened on the first target stand, the first target stand drives the first target board to perform movements of falling sideway, falling sideway and then rotating, and rotating, relative to the operation box; a second mode control unit, fastened in the operation box and on one side of the operation box near proximate the second hole, the second mode control unit comprising a second power module, a second target stand, and a second target board, the second target stand being dynamically coupled to the second power module and located outside the fixed box, the second target board fastened on the second target stand, the second target stand drives the second target board to perform a movement of falling backward relative to the operation box; and a target shooting mode switching unit, electrically coupled to the first mode control unit and the second mode control unit, switching power output between the first mode control unit and the second mode control unit to drive one of the first and second mode control units.

2. The dual-purpose multi-axis target shooting machine steering device according to claim 1, wherein the first power module comprises a first fasten frame, a first motor, a first transmission mechanism, a first target arm, and a second motor, the first fasten frame is mounted on the side of the operation box proximate the first hole, the first motor and the first transmission mechanism are mounted on the first fasten frame, the first motor comprises a first drive shaft, and the first transmission mechanism comprises a first input shaft and a first output shaft, such that the first drive shaft is dynamically combined with the first input shaft, one end of the first output shaft is passed through the first hole and combined with the first target arm, another end of the first output shaft is combined with the second motor, and the second motor comprises a second drive shaft, and the second drive shaft is dynamically combined with the first target stand.

3. The dual-purpose multi-axis target shooting machine steering device according to claim 2, further comprising a first limiting mechanism with a first positioning ring, a first stop part, and a first snap-action switch, wherein the first positioning ring is arranged at the first output shaft, and the first stop part and the first snap-action switch are located on a rotation path of the first positioning ring, an angle between the first stop part and the first snap-action switch is 90 degrees with respect to the first output shaft, and the first snap-action switch is electrically combined with the first motor, and an operation of the first motor goes off immediately after the first positioning ring triggers the first snap-action switch.

4. The dual-purpose multi-axis target shooting machine steering device according to claim 3, wherein one end of the first target arm comprises a first retaining ring to sheath on the first output shaft, and another end of the first target arm comprises a first positioning part to install the first target stand.

5. The dual-purpose multi-axis target shooting machine steering device according to claim 1, wherein the second power module comprises a second fasten frame, a third motor, a second transmission mechanism, and a second target arm, the second fasten frame is installed on the one side of the operation box proximate the second hole, the third motor and the second transmission mechanism are installed on the second fasten frame, the third motor comprises a third drive shaft, and the second transmission mechanism comprises a second input shaft and a second output shaft, such that the third drive shaft is dynamically combined with the second input shaft, and the second output shaft is passed through the second hole and connected to the second target arm.

6. The dual-purpose multi-axis target shooting machine steering device according to claim 5, further comprising a second limiting mechanism with a second positioning ring, a second stop part, and a second snap-action switch, wherein the second positioning ring is installed on the second output shaft, and the second stop part and the second snap-action switch are located on a rotation path of the second positioning ring, an angle between the second stop part and the snap-action switch is 90 degrees with respect to the second output shaft, the second snap-action switch being electrically connected to the third motor, and an operation of the third motor goes off immediately after the second positioning ring triggers the second snap-action switch.

7. The dual-purpose multi-axis target shooting machine steering device according to claim 6, wherein one end of the second target arm comprises a second retaining ring, and another end of the second retaining ring comprises the second output shaft for sheathing, and another end of the second target arm comprises a second fasten part for installing the second target stand.

8. The dual-purpose multi-axis target shooting machine steering device according to claim 1, further comprising a power input module installed on one side of the operation box opposite a side where the first hole is located, wherein the power input module is electrically connected to the target shooting mode switching unit.

9. The dual-purpose multi-axis target shooting machine steering device according to claim 1, wherein the first target board and the second target board are installed on the first target stand and the second target stand by clamping.

* * * * *